US008826683B2

(12) United States Patent
Nuss et al.

(10) Patent No.: US 8,826,683 B2
(45) Date of Patent: Sep. 9, 2014

(54) ICE DISPENSER WITH CRUSHER FOR A REFRIGERATOR APPLIANCE

(75) Inventors: Bart Andrew Nuss, Fisherville, KY (US); Alan Joseph Mitchell, Louisville, KY (US)

(73) Assignee: General Electric Company, Schenectady, NY (US)

( * ) Notice: Subject to any disclaimer, the term of this patent is extended or adjusted under 35 U.S.C. 154(b) by 144 days.

(21) Appl. No.: 13/474,889

(22) Filed: May 18, 2012

(65) Prior Publication Data

US 2013/0104587 A1 May 2, 2013

Related U.S. Application Data

(63) Continuation-in-part of application No. 13/285,122, filed on Oct. 31, 2011.

(51) Int. Cl.

| | |
|---|---|
| ***F25C 5/02*** | (2006.01) |
| ***F25C 5/00*** | (2006.01) |
| ***F25C 5/04*** | (2006.01) |

(52) U.S. Cl.

CPC ..... *F25C 5/005* (2013.01); *F25C 2400/08* (2013.01); *F25C 5/046* (2013.01)

USPC ..... 62/320; 62/344

(58) Field of Classification Search

USPC ..... 62/354, 353, 344, 425, 420, 320

See application file for complete search history.

(56) References Cited

U.S. PATENT DOCUMENTS

| | | | | |
|---|---|---|---|---|
| 4,084,725 | A | 4/1978 | Buchser | |
| 6,082,130 | A | 7/2000 | Pastryk et al. | |
| 7,111,473 | B2 * | 9/2006 | Chung et al. | 62/320 |
| 7,743,622 | B2 * | 6/2010 | Fischer et al. | 62/344 |
| 7,963,120 | B2 * | 6/2011 | An et al. | 62/344 |
| 2006/0059939 | A1 * | 3/2006 | An et al. | 62/344 |
| 2007/0171767 | A1 * | 7/2007 | Huang | 366/289 |

* cited by examiner

*Primary Examiner* — Allana Lewin
*Assistant Examiner* — Kun Kai Ma
(74) *Attorney, Agent, or Firm* — Dority & Manning, P.A.

(57) ABSTRACT

An ice dispenser for a refrigeration appliance is provided that can deliver both crushed ice and whole or non-crushed ice. A rotating drum or cylinder carries one or more blades that can crush ice against non-rotating blades carried on an axis or rod that extends into the drum. The direction of rotation of the drum can be selected so as to determine whether crushed or non-crushed ice is dispensed. The dispensing system can be located on the door of the refrigerator. An ice maker can also be positioned with the ice dispenser on the door of the appliance or, optionally, can be located in a compartment of the refrigerator.

20 Claims, 10 Drawing Sheets

ICE DISPENSER WITH CRUSHER FOR A REFRIGERATOR APPLIANCE

PRIORITY CLAIM

This application is a continuation-in-part application of and claims priority to U.S. patent application Ser. No. 13/285,122 filed on Oct. 31, 2011, which is incorporated herein by reference for all purposes.

FIELD OF THE INVENTION

The subject matter of the present disclosure relates to an ice dispenser for a refrigerator appliance and, more specifically, to an ice dispenser also having an ice crusher.

BACKGROUND OF THE INVENTION

Generally, a refrigerator includes a freezer compartment and a fresh food compartment, which are partitioned from each other to store various foods at appropriate low temperatures. It is common to provide an automatic icemaker/water dispenser with a refrigerator. In a "side-by-side" type of refrigerator where the freezer compartment is arranged to the side of the fresh food compartment, the icemaker is usually disposed in the freezer compartment and, thus, utilizes the cold air in the freezer compartment, which typically includes an evaporator also disposed in the freezer compartment.

In a "bottom freezer" type of refrigerator where the freezer compartment is arranged beneath a top mounted fresh food compartment, convenience necessitates that the icemaker is disposed in a sub-compartment (often referred to as an "icebox") that is usually thermally insulated and configured in one of the top mounted fresh food compartment doors with ice delivered through an opening on the door. In such an arrangement, provision must be made for providing adequate refrigeration to the icebox to enable the icemaker to form and store the ice. An access door is commonly provided on the icebox to allow the consumer to access the internal ice bucket and icemaker.

Typically, the ice maker delivers ice into a storage container or bucket where the ice is kept until used. A panel on the front of the refrigerator allows the user to select between the dispensing of crushed ice or non-crushed ice. Conventionally, the ice is pushed by e.g., an auger through a chute or channel equipped with one or more blades, which are carried on a shaft and rotate with the shaft to contact and crush the ice. Chilled water can also be provided by routing a thermally conductive conduit to the panel such that the water is cooled before reaching the dispenser.

The ice container and dispenser can consume a significant amount of space from the freezer or fresh food compartment. Space is consumed not only by the volume required for ice creation and storage, but the mechanisms for moving and/or crushing the ice can also consume space the user might otherwise prefer to have available for food storage. Additionally, the mechanisms needed for crushing ice can also consume additional space. Depending upon how the components are positioned within these compartments, user access to portions of the compartment and/or to the ice storage container (e.g., for cleaning or manually collecting ice) can be inconvenient as well.

Accordingly, an ice dispensing system for a refrigerator appliance would be useful. More particularly, an ice dispensing system for a refrigerator appliance that can allow for the positioning of the ice storage container and/or ice crushing mechanism on a door of the refrigerator would be beneficial as it could provide savings in space. Additionally, such a system that can provide more convenient access to the refrigerator compartments and/or the ice storage container would be also be useful.

BRIEF DESCRIPTION OF THE INVENTION

The present invention provides an ice dispensing system for a refrigeration appliance. The ice dispensing system includes a mechanism for crushing ice such that both crushed ice or non-crushed ice can be dispensed to a user of the appliance. A rotating drum or cylinder carries one or more blades that can crush ice against non-rotating blades carried on an axis or rod that extends into the drum. The direction of rotation of the drum can be selected so as to determine whether crushed or non-crushed ice is dispensed. The dispensing system can be located on the door of the refrigerator. An ice maker can also be positioned with the ice dispenser on the door of the appliance or, optionally, can be located in a compartment of the refrigerator. Additional aspects and advantages of the invention will be set forth in part in the following description, or may be obvious from the description, or may be learned through practice of the invention.

In one exemplary embodiment, the present invention provides an ice dispensing assembly for an appliance. The assembly includes a container for the receipt of ice. The container has a bottom defining a first opening for the passage of ice from the container. A cylindrically-shaped sleeve is connected with the opening at the bottom of the container and extending from the bottom of the container. A base is connected with the sleeve and defines a second opening for the passage of ice from the container. A cylinder is positioned at least partially within the sleeve and is rotatable with respect to the sleeve. The cylinder has a wall and defines an inner diameter. At least one rotatable blade extends along the inner diameter between opposing ends positioned at the wall of the cylinder. The at least one rotatable blade defines a guide hole that is centrally positioned along the at least one rotatable blade. A shaft extends into the cylinder and through the guide hole of the at least one rotatable blade. The shaft has a bottom end connected to the base. At least one non-rotating blade is attached to the shaft.

In another exemplary embodiment, the present invention provides a refrigerator that includes a cabinet, a fresh food compartment, a freezer compartment, or both, and an ice maker. An ice dispensing assembly is provided that comprises a container for the receipt of ice from the ice maker. The container has a bottom defining a first opening for the passage of ice from the container. A cylindrically-shaped sleeve is connected with the opening at the bottom of the container and extends from the bottom of the container. A base is connected with the sleeve. The base defines a second opening for the passage of ice from the container. A cylinder is positioned at least partially within the sleeve and is rotatable with respect to the sleeve. The cylinder has a wall and defining an inner diameter. At least one rotatable blade extends along the inner diameter between opposing ends positioned at the wall of the cylinder. The at least one rotatable blade defines a guide hole that is centrally positioned along the at least one rotatable blade. A shaft extends into the cylinder and through the guide hole of the at least one rotatable blade. The shaft has a bottom end connected to the base. At least one non-rotating blade is attached to the shaft.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
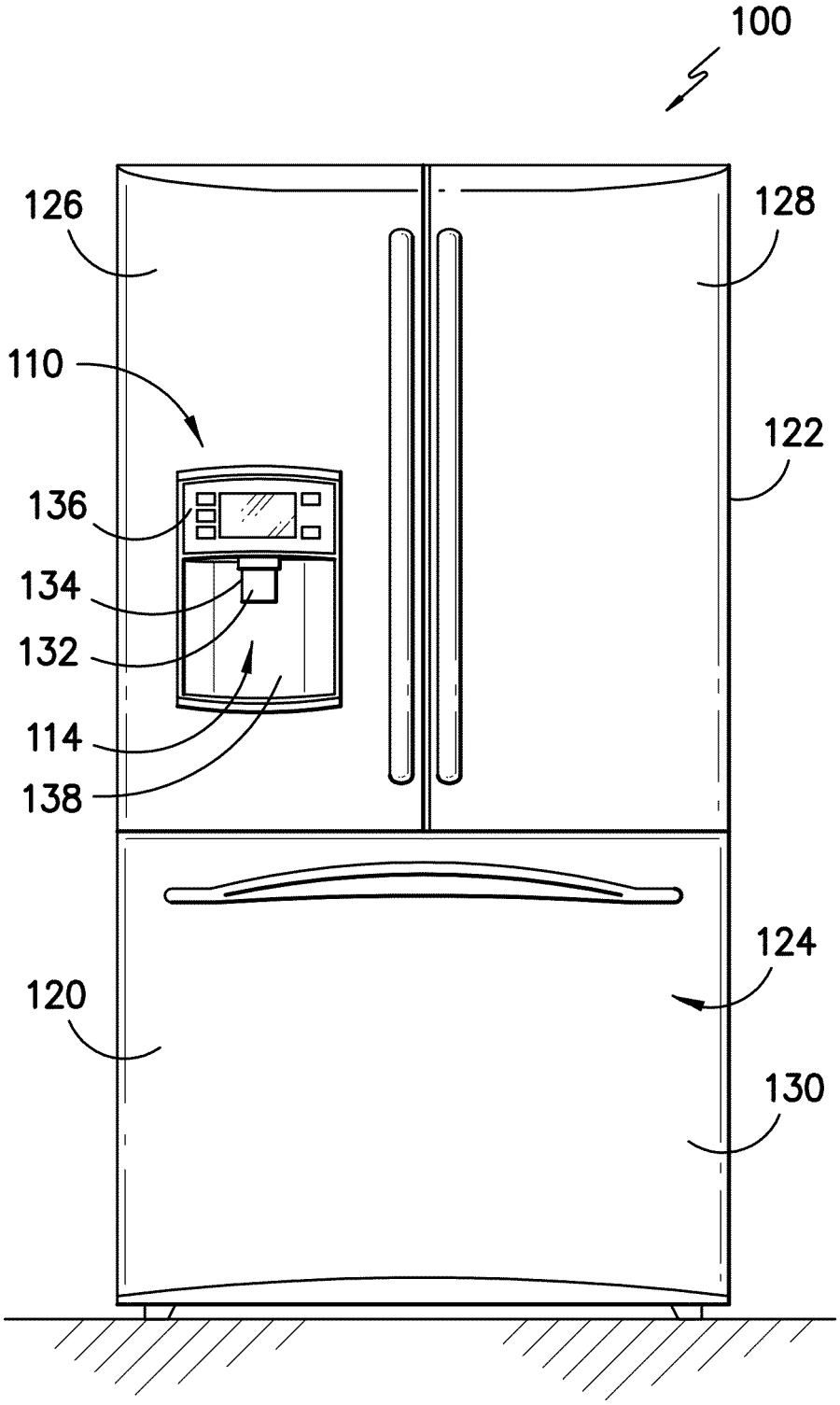
FIG. 1 illustrates an exemplary embodiment of a refrigerator appliance as may be used with the present invention.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a front view of a refrigerator 100 including an ice-dispensing assembly 110 for dispensing water and/or ice. In this exemplary embodiment, ice-dispensing assembly 110 includes a dispenser 114 positioned on an exterior portion of refrigerator 100. Refrigerator 100 includes a cabinet 120 having an upper fresh food compartment 122 and a lower freezer compartment 124 arranged at the bottom of refrigerator 100. As such, refrigerator 100 is generally referred to as a bottom mount refrigerator. In the exemplary embodiment, cabinet 120 also defines a mechanical compartment (not shown) for receipt of a sealed cooling system. Using the teachings disclosed herein, one of skill in the art will understand that the present invention can be used with other types of refrigerators (e.g., side-by-sides) as well. Consequently, the description set forth herein is for illustrative purposes only and is not intended to limit the invention in any aspect.

Refrigerator doors 126, 128 are rotatably hinged to an edge of cabinet 120 for accessing fresh food compartment 122. A freezer door 130 is arranged below refrigerator doors 126, 128 for accessing freezer compartment 124. In the exemplary embodiment, freezer door 130 is coupled to a freezer drawer (not shown) slidably coupled within freezer compartment 124.

For this exemplary embodiment, dispenser 114 includes a discharging outlet 132 for accessing ice and water. A single paddle 134 is mounted below discharging outlet 132 for operating dispenser 114. A user interface panel 136 is provided for controlling the mode of operation. For example, user interface panel 136 includes a water dispensing button (not labeled) and an ice-dispensing button (not labeled) for selecting a desired mode of operation such as crushed or non-crushed ice.

Discharging outlet 132 and paddle 134 are an external part of dispenser 114, and are mounted in a concave portion 138 defined in an outside surface of refrigerator door 126. Concave portion 138 is positioned at a predetermined elevation convenient for a user to access ice or water enabling the user to access ice without the need to bend-over and without the need to access freezer compartment 124. In the exemplary embodiment, concave portion 138 is positioned at a level that approximates the chest level of a user.

Figure 2:
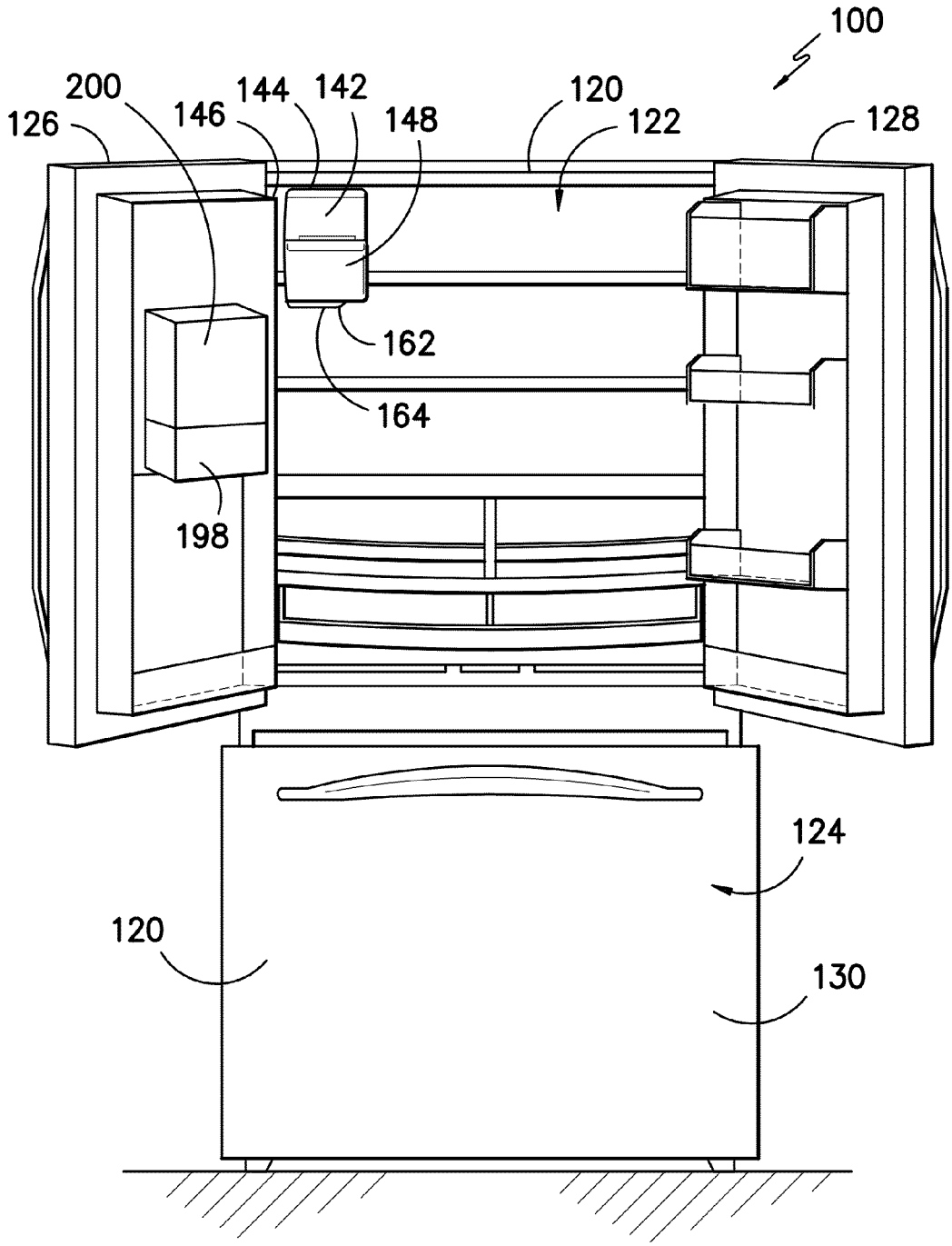
FIG. 2 provides another illustration of the exemplary embodiment of FIG. 1 with doors to the fresh food compartment shown in an open position.

FIG. 2 is a perspective view of refrigerator 100 having doors 126, 128 in an open position to reveal the interior of the fresh food compartment 122. As such, certain components of this exemplary embodiment of the ice dispensing assembly 110 are illustrated. Ice-dispensing assembly 110 includes an insulated housing 142 mounted within refrigerator compartment 122 along an upper surface 144 of compartment 122 and along a sidewall 146 of compartment 122. Insulated housing 142 includes insulated walls 148 defining an insulated cavity (not shown). Due to the insulation which encloses the cavity, the temperature within the cavity can be maintained at levels different from the temperature in the surrounding fresh food compartment 122.

In this exemplary embodiment, the insulated cavity is constructed and arranged to operate at a temperature that facilitates producing and storing ice. More particularly, the insulated cavity contains an ice maker for creating ice and feeding the same to a container 200 that is mounted on refrigerator door 126. As illustrated in FIG. 2, container 200 is placed at a vertical position on refrigerator door 126 that will allow for the receipt of ice from a discharge opening 162 located along a bottom edge 164 of insulated housing 142. As door 126 is closed or opened, container 200 is moved in and out of position under insulated housing 142. Alternatively, in another exemplary embodiment of the present invention, insulated housing 142 and its ice maker can be positioned directly on door 126. In still another embodiment of the present invention, in a configuration where the fresh food compartment and the freezer compartment are located side by side (as opposed to over and under as shown in FIGS. 1 and 2), the ice maker could be located on the door for the freezer compartment and directly over container 200. As such, the use of an insulated housing would be unnecessary. Other configurations for the location of ice container 200, an ice maker, and/or insulated housing 142 may be used as well.

Operation of the refrigerator 100 can be regulated by a controller (not shown) that is operatively coupled to user interface panel 136 and/or paddle 134. Panel 136 provides selections for user manipulation of the operation of refrigerator 100 such as e.g., selections between whole or crushed ice, chilled water, and/or other options as well. In response to user manipulation of the user interface panel 136, the controller operates various components of the refrigerator 100. The controller may include a memory and one or more microprocessors, CPUs or the like, such as general or special purpose microprocessors operable to execute programming instructions or micro-control code associated with operation of refrigerator 100. The memory may represent random access memory such as DRAM, or read only memory such as ROM or FLASH. In one embodiment, the processor executes programming instructions stored in memory. The memory may be a separate component from the processor or may be included onboard within the processor.

The controller may be positioned in a variety of locations throughout refrigerator 100. In the illustrated embodiment, the controller may be located within the control panel area of door 126. In such an embodiment, input/output ("I/O") signals may be routed between the controller and various operational components of refrigerator 100 such as a motor for rotating components of an ice crusher as will be described further below. In one embodiment, the user interface panel 136 may represent a general purpose I/O ("GPIO") device or functional block. In one embodiment, the user interface 136 may include input components, such as one or more of a variety of electrical, mechanical or electro-mechanical input devices including rotary dials, push buttons, and touch pads. The user interface 136 may include a display component, such as a digital or analog display device designed to provide operational feedback to a user. The user interface 136 may be in communication with the controller via one or more signal lines or shared communication busses.

Figure 3:
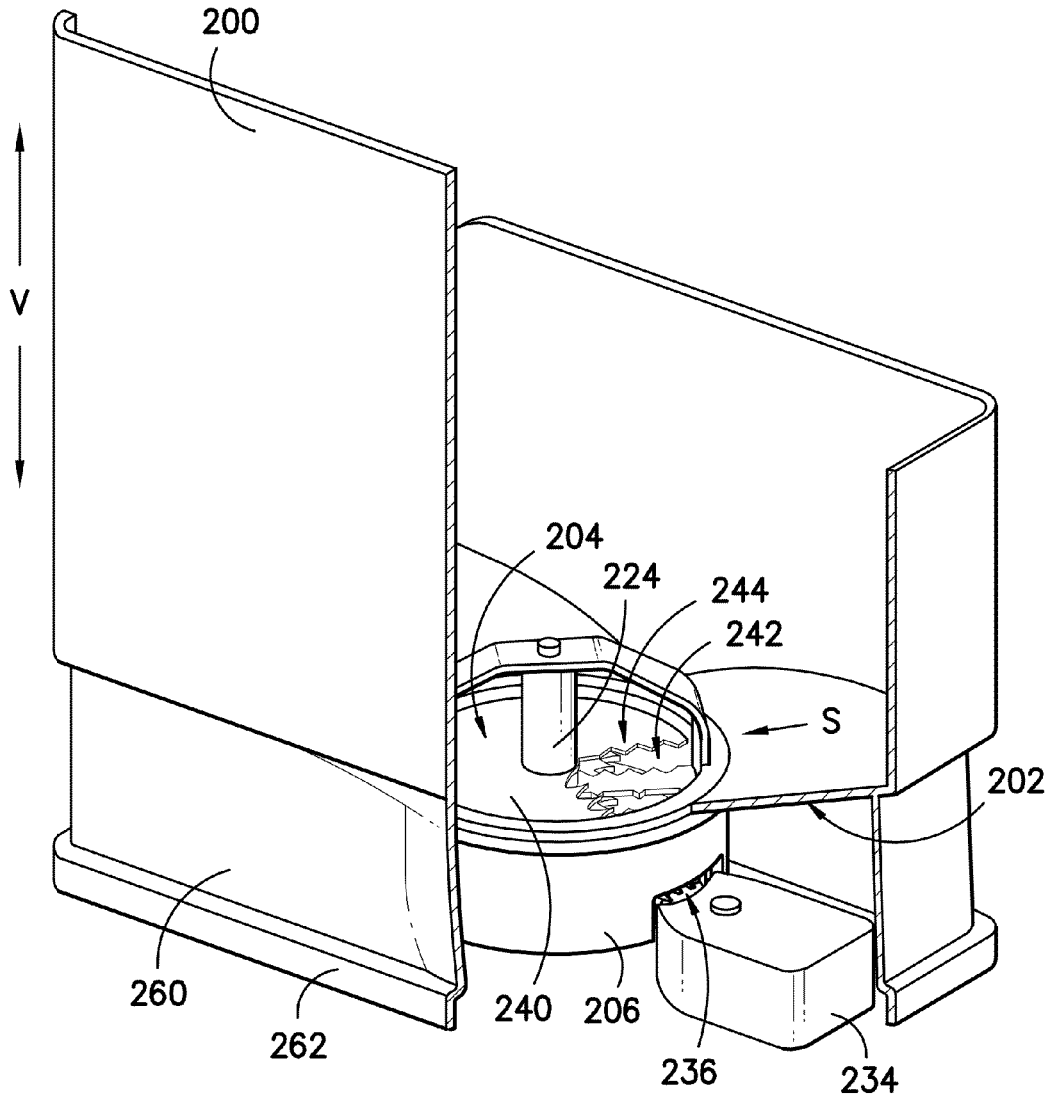
FIG. 3 depicts a perspective view of an ice storage container and crusher in an exemplary embodiment of an ice dispensing assembly of the present invention. For purposes of revealing interior components in this view, a portion of the storage container is removed.
Figure 4:
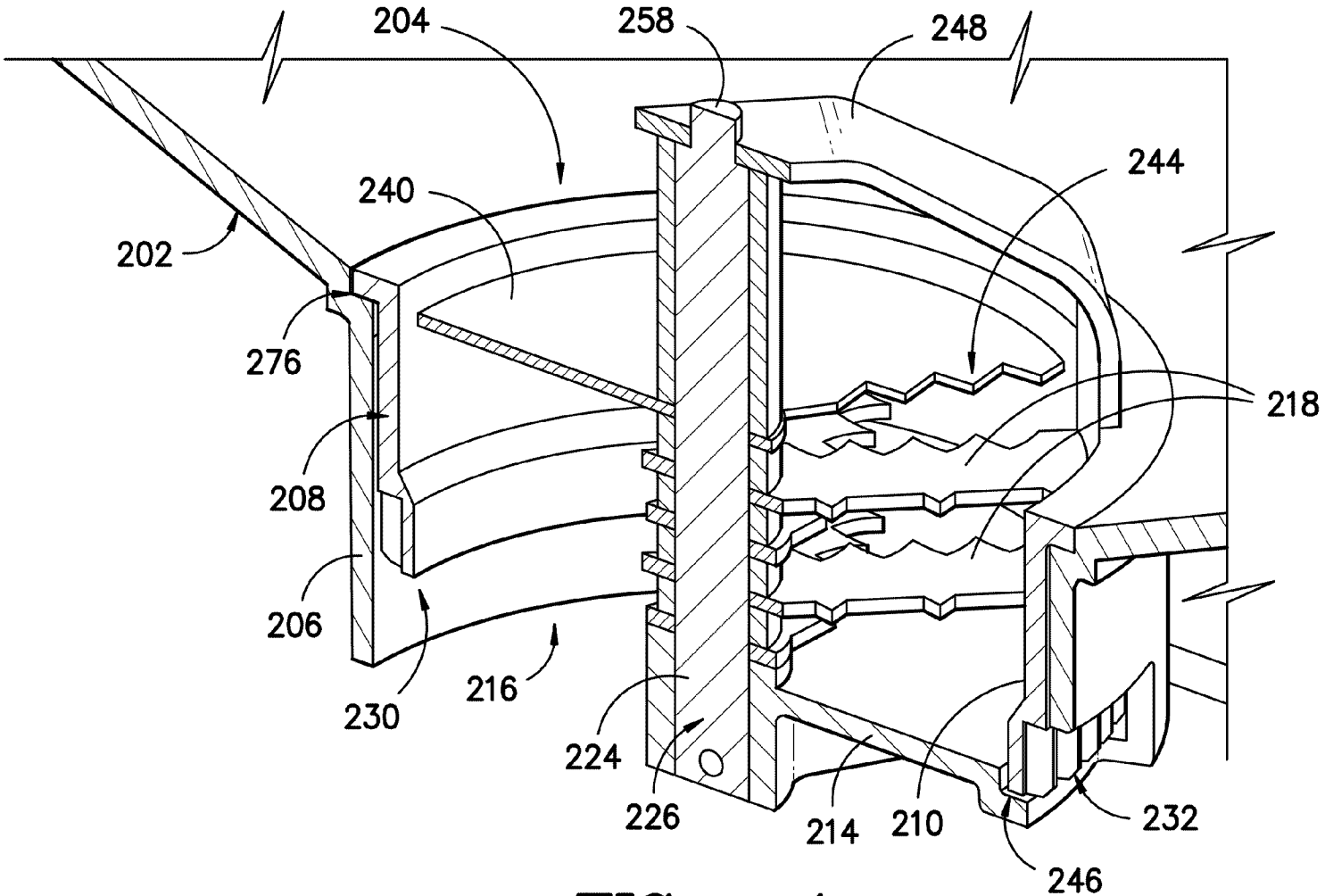
FIG. 4 illustrates a cross-sectional view of a bottom portion of the exemplary ice storage container of FIG. 3.

An exemplary embodiment of the ice storage container 200 along with an ice crushing mechanism as may be used with ice dispensing assembly 110 is further illustrated in FIG. 3. For purposes of revealing interior components in this view, a portion of the storage container 200 is removed. Container 200 has a bottom 202 that defines a first opening 204. FIG. 4 illustrates a cross-sectional view taken at the bottom 202 of container 200 near first opening 204. Ice (not shown) can pass from container 200 and through opening 204 into a drum or rotatable cylinder 208. Bottom 202 is sloped towards first opening 204 to help direct ice towards first opening 204 as indicated by arrow S.

As shown, cylinder 208 is positioned at first opening 204 within a cylindrically-shaped sleeve 206 that is also located at first opening 204. Sleeve 206 is connected with the bottom 202 of container 200 and is integrally formed with container 200. As shown in the perspective view of the bottom of container 200 provided in FIG. 5, a base 214 is connected with sleeve 206. Base 214 closes off sleeve 206 except for a second opening 216 through which ice may flow for dispensing. Cylinder 208 is rotatable with respect to sleeve 206. The movement of cylinder 208 is created by a motor 234 (FIG. 3) as will be further described.

Referring now to FIGS. 4 through 9, a plurality of rotatable blades 218 are carried by cylinder 208 as it rotates within sleeve 206. Blades 218 extend along the inner diameter 212 of cylinder 208 between opposing ends 220 (FIG. 9) that in turn are positioned at the wall 210 of cylinder 208. Although two rotatable blades 218 are shown, one or more such blades may be used in other embodiments of the present invention. Rotatable blades 218 include teeth 270 for crushing ice.

A bridge 248 extends between opposing ends 250 that are connected to the wall 210 of cylinder 208. Bridge 248 projects from cylinder 208 along vertical direction V. Accordingly, cylinder 208 and bridge 248 rotate together. The movement of bridge 248 stirs ice in container 200 to help move the ice into opening 204. The shape or appearance of bridge 248 can have other configurations different from that shown in the figures.

Figure 5:
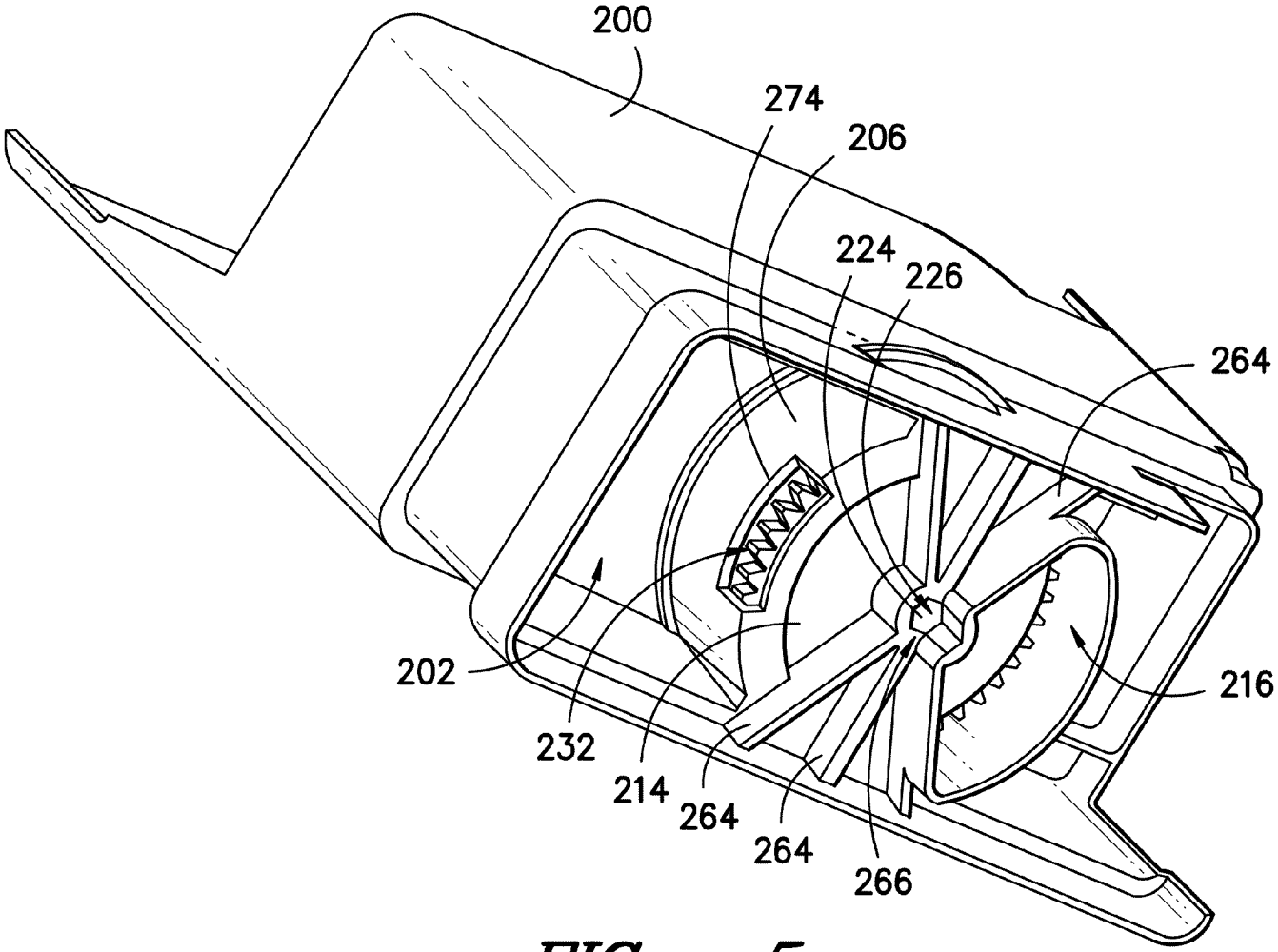
FIG. 5 is perspective view of the bottom of the exemplary ice storage container of FIG. 3.

A non-rotating shaft 224 extends into cylinder 208 along vertical direction V. Shaft 224 has a bottom end 226 that is fixed into base 214. More particularly, as best seen in FIG. 5, bottom end 226 has a hexagonal shape received in a complementary manner into a hexagonally-shaped hole 266 in base 214. A plurality of struts 264 extend between the sides of container 200 and provide structural support. For this exemplary embodiment, container 200 is constructed from a plastic material along with struts 264. One or more of these struts 264 can incorporate reinforcement such as e.g., a steel bar positioned within strut 264 using an insert molding process.

Shaft 224 also extends through guide holes 222 in rotatable blades 218, which can freely rotate with cylinder 208 since shaft 224 and rotatable blades 218 are not connected. The top end 258 of shaft 224 is received into a guide hole 256 in the central portion 254 of bridge 248. The diameter of guide hole 256 is slightly larger than the diameter of the top end 258 of shaft 224. As such, bridge 248 can freely rotate with cylinder 208 about fixed shaft 224 to stir the ice. At the same time, bridge 248 helps support shaft 224 and orient top end 258.

Figure 7:
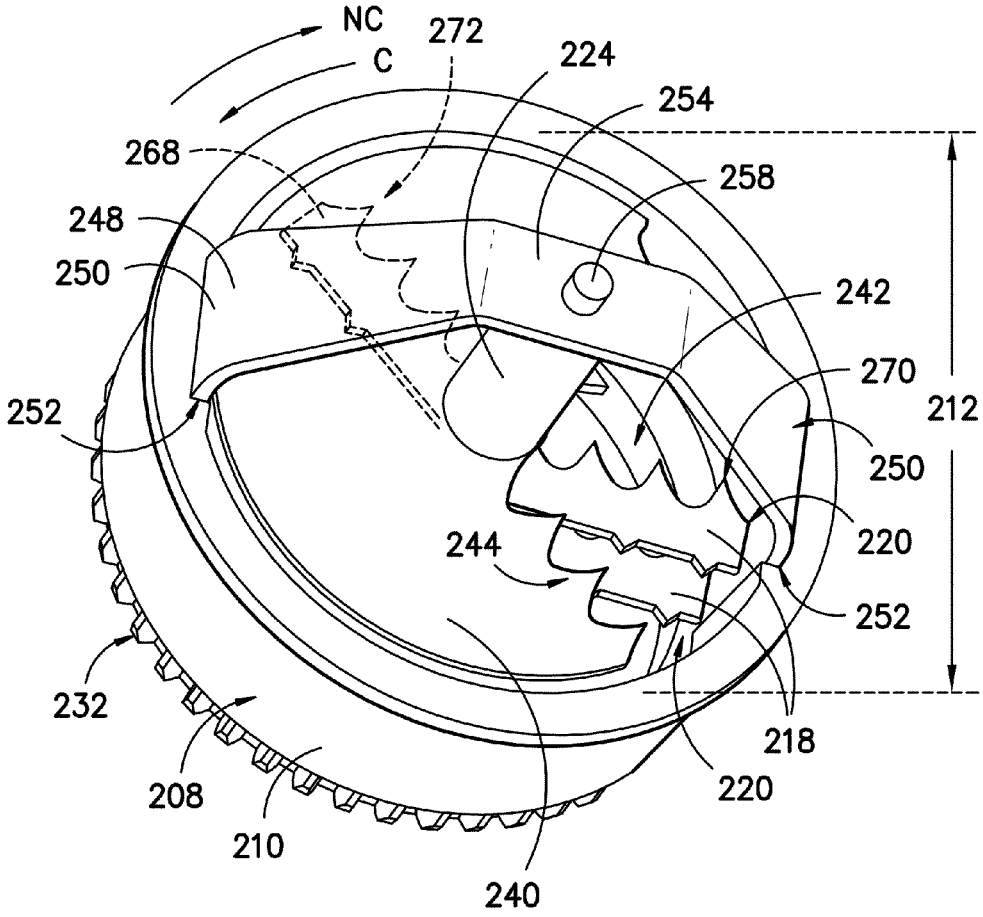
FIG. 7 is a top perspective view of the exemplary cylinder of FIG. 6.
Figure 8:
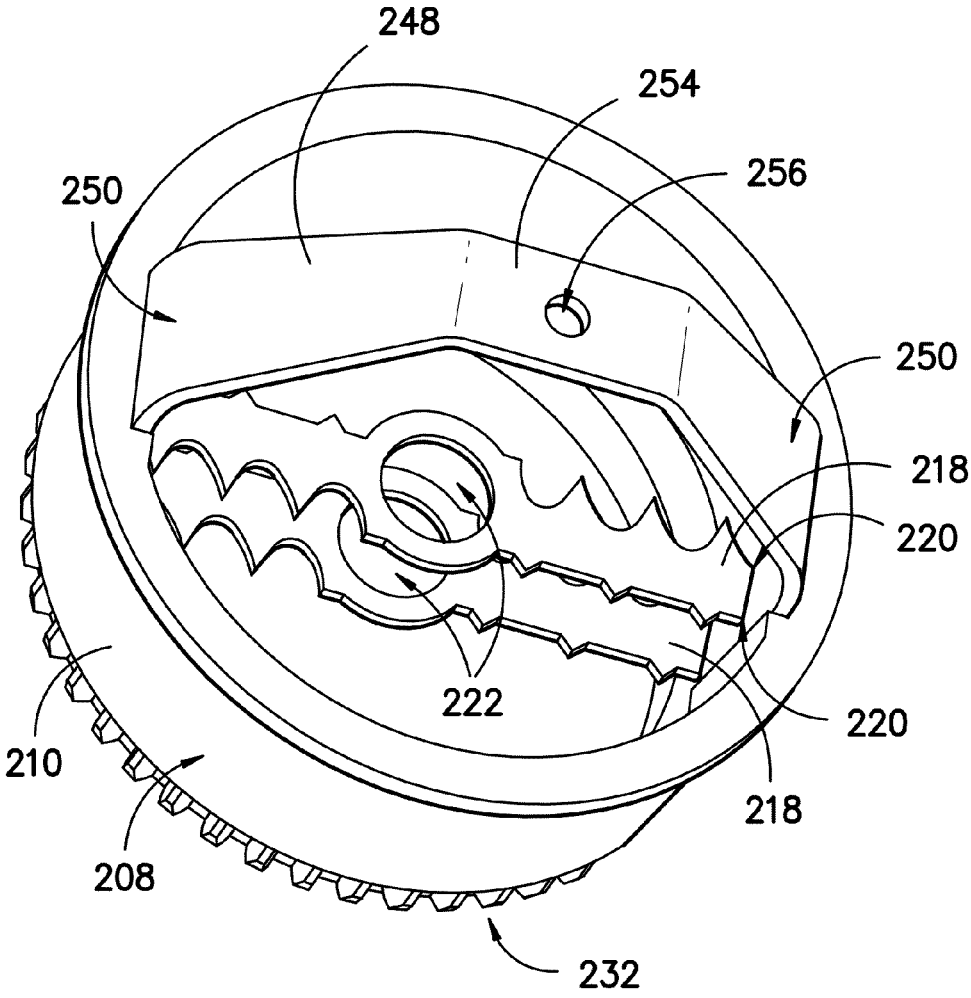
FIG. 8 is a top perspective view of the exemplary cylinder of FIG. 6 with a metering plate removed to more fully illustrate other components.
Figure 9:
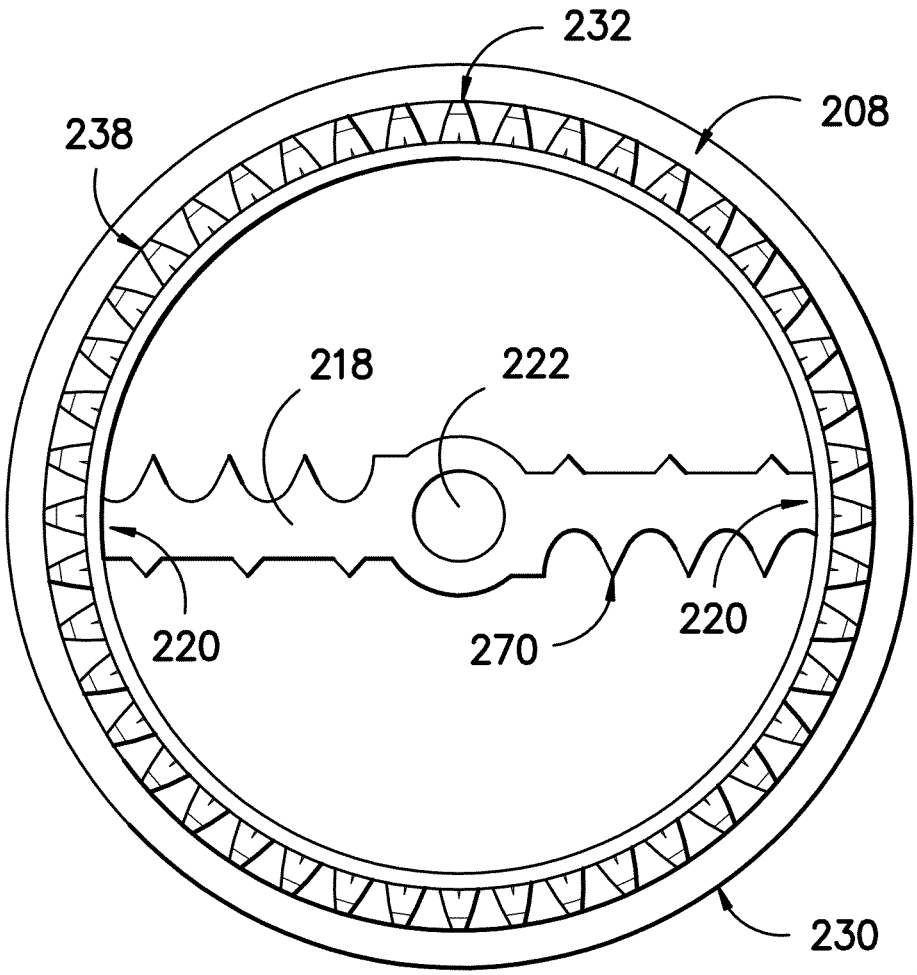
FIG. 9 is a partial cross-sectional view of the exemplary embodiment of the ice storage container shown in FIG. 4 along with an exemplary motor connected with the cylinder.

As best shown in FIGS. 7 and 8, bridge 248 and rotatable blades 218 can be constructed as an integral piece (i.e.,integrally formed) from e.g., a metal such as steel. During assembly, this integral piece can be slid into cylinder 208 along a pair of opposing recesses 252 in wall 210. Other configurations may be used as well for construction of blades 218, bridge 248, and cylinder 208.

Figure 10:
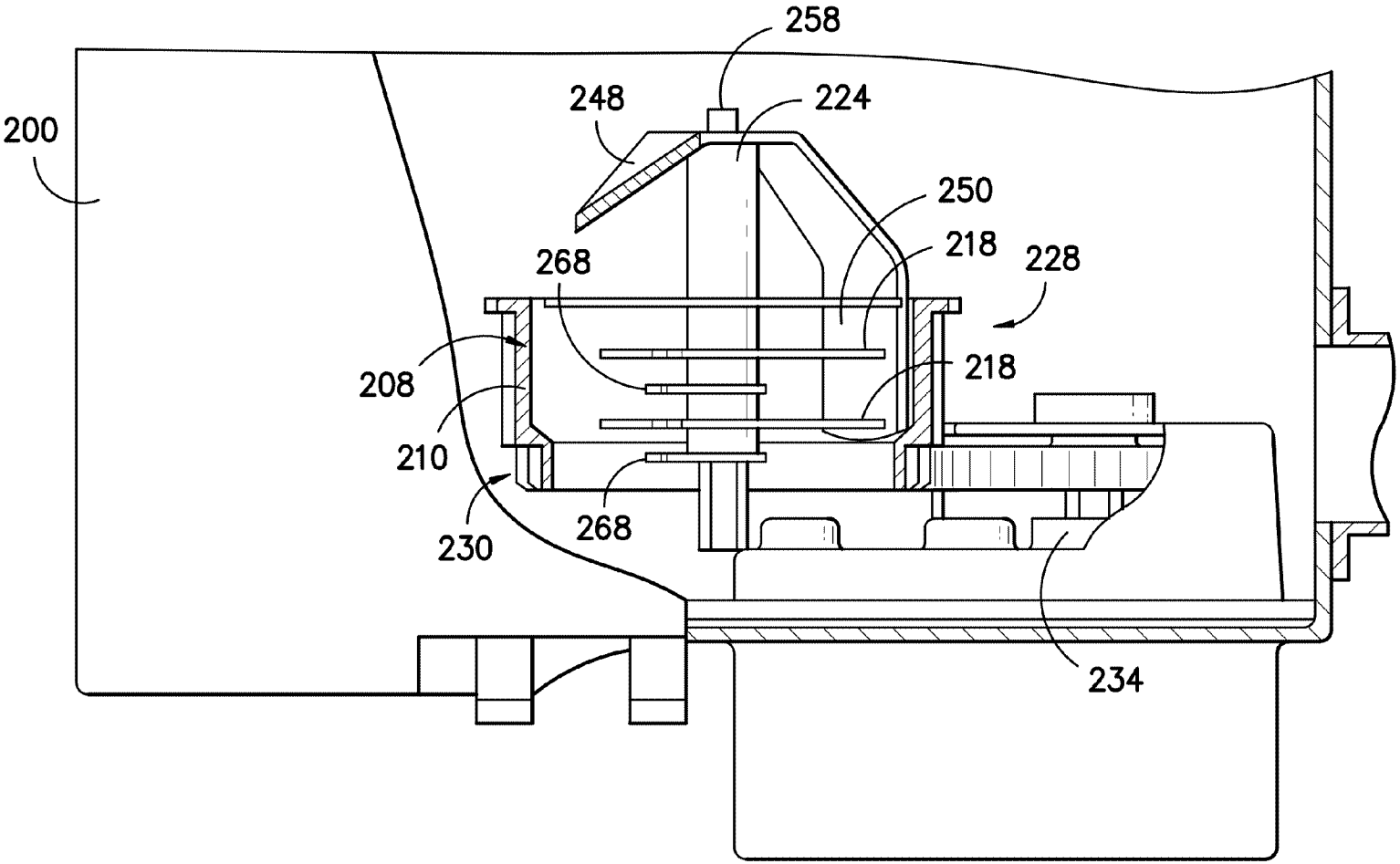
FIG. 10 is a partial cross-sectional view of a portion of the exemplary ice storage container shown in FIG. 3.

Referring to FIGS. 7 and 10, a plurality of non-rotatable blades 268 are attached to shaft 224 and do not rotate with cylinder 208. For this exemplary embodiment of ice container 200, blades 268 extend from shaft 224 along one side to wall 210 but without connecting to wall 210. During operation, rotation of cylinder 208 in the direction of arrow C moves the teeth 270 of rotatable blades 218 towards the teeth 272 of non-rotating blades 268. Accordingly, ice delivered into cylinder 208 from container 200 will be crushed between teeth 270 and 272 to provide crushed ice to the user. Conversely, by rotating cylinder 208 in the direction of arrow NC, the teeth 270 of rotatable blades 218 will be moved away from teeth 272 of non-rotating blades 268. As such, ice delivered into cylinder 208 from container 200 will not be crushed so that whole ice can be delivered to the user.

The amount of ice delivered into cylinder 208 from container 200 is controlled by a metering plate 240. As best shown in FIGS. 4 and 7, metering plate 240 is attached to fixed shaft 224 and does not rotate with cylinder 208. Metering plate 240 defines an opening or aperture 242 through which ice must pass in order to move through cylinder 208. As such, aperture 242 can be sized to provide the desired flow rate of ice from container 200. Teeth 244 positioned along an edge of metering plate 240 help crush ice as cylinder 200 rotates so as to prevent jams.

Figure 6:
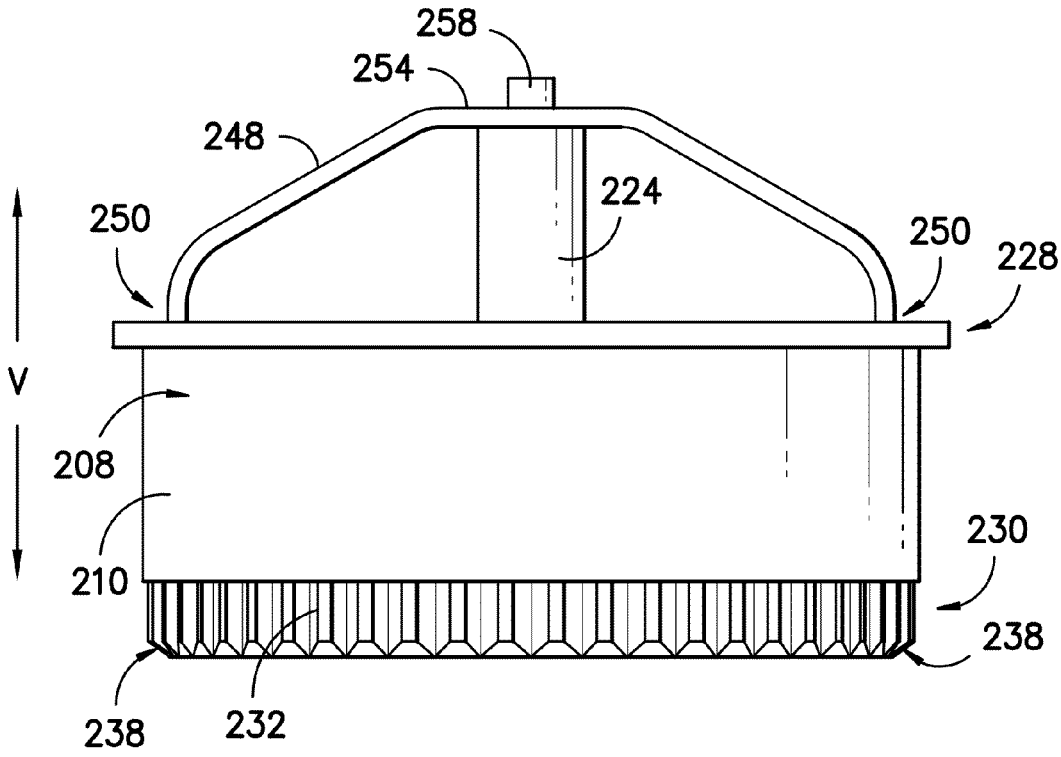
FIG. 6 provides a side view of an exemplary cylinder as used with the ice storage container of FIG. 3.

As previously indicated, motor 234 is used to rotate cylinder along either direction C or direction NC. As shown in FIGS. 4 through 9, the bottom end 230 of cylinder 200 is provided with a first plurality of gear teeth 232 positioned circumferentially around cylinder 200. Teeth 232 extend through a slot 274 in base 214 (FIG. 5). As best shown in FIG. 6, the first plurality of gear teeth 232 each have a beveled surface 238.

Referring to FIGS. 3 and 5, teeth 232 of cylinder 200 are driven by a second plurality of gear teeth 236 of motor 234. Teeth 236 are also beveled in a complementary manner to gear teeth 232. Motor 234 is affixed to a base or platform 198 on door 126. During operation, a user may remove ice container 200 from platform 198 on door 126 in order to clean container 200 and or dump ice. This removal disengages gear teeth 232 and 236 from each other. Upon returning container 200 to platform 198, it is important for gear teeth 232 and 236 to reengage or mesh so that motor 234 can rotate cylinder 208. Accordingly, the beveling of teeth 232 and 236 provide for proper realignment so that teeth will properly reengage when container 200 is placed back onto platform 198.

Additionally, container 200 also includes a skirt 260 with flange 262 that each extend around container 200 as shown in FIG. 3. Skirt 260 includes a slight taper along the vertical direction. For example, the taper may be about 5 to 7 degrees from the vertical direction. This taper helps container 200 properly seat and re-align when positioned onto platform 198.

During rotation of cylinder 208 as described, considerable torque may be provided by motor 234. In order to maintain the alignment of cylinder 208, base 214 is provided with a circumferentially-extending groove 247. The bottom end 230 of cylinder 208 is received into groove 247 as shown in FIG. 4. Circumferentially-extending groove 276 provided in sleeve 206 performs a similar function; top end 228 of cylinder 208 is received into groove 276.

By way of example of the operation of ice dispensing assembly 110, ice is dropped into container 200 from the ice maker through opening 162 in insulated housing 142. The slope of bottom 202 directs ice toward first opening 204 (arrow S in FIG. 3) so that ice may move through aperture 242 in metering plate 240 and into cylinder 208 under the force of gravity. The rotation of cylinder 208 helps stir the ice and facilitate movement as bridge 248 will move ice near bottom 202.

Depending upon whether the user has selected crushed or whole ice using interface panel 136, the controller can determine the direction of rotation of cylinder 208 by powering motor 234 as required. Such rotation could be activated based upon e.g., the depressing of paddle 134 by a user such that a request for ice is received by the controller. The controller could then activate motor 234 in the proper direction for crushed or whole ice.

If the user has selected crushed ice, cylinder 208 is rotated so that the movement of rotatable blades 218 relative to the non-rotating blades 268 will pinch and then crush ice between teeth 270 and 272 (arrow C in FIG. 7). As ice travels vertically down through cylinder 208, multiple blades 218 and 268 can be provided as shown so as to help ensure that the ice is crushed sufficiently. Alternatively, if the user has selected whole or non-crushed ice, drum 208 is rotated so that the movement of rotatable blades 218 relative to non-rotating blades 268 will avoid crushing ice therebetween (arrow NC in FIG. 7). After travelling down sleeve 206, crushed or whole ice can exit through second opening 216 and pass through discharge outlet 132 into e.g., the user's cup or glass.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An ice dispensing assembly for an appliance, comprising:

a container for the receipt of ice, said container having a bottom defining a first opening for the passage of ice from said container;

a cylindrically-shaped sleeve connected with the first opening at the bottom of said container and extending from the bottom of said container;

a base connected with said sleeve, said base defining a second opening for the passage of ice from said container;

a cylinder positioned at least partially within said sleeve and rotatable with respect to said sleeve, said cylinder having a wall and defining an inner diameter;

at least one rotatable blade carried by said cylinder and extending along the inner diameter between opposing ends positioned at the wall of said cylinder, said at least one rotatable blade defining a guide hole that is centrally positioned along said at least one rotatable blade;

a shaft extending along a vertical direction perpendicular to said base into said cylinder and through the guide hole of said at least one rotatable blade, said shaft having a bottom end connected to said base;

at least one non-rotating blade attached to said shaft; and a bridge connected along opposing ends to the wall of said cylinder and projecting away from said cylinder along the vertical direction to a central portion that defines an opening for receipt of a top end of said shaft.

2. An ice dispensing assembly as in claim 1, wherein said cylinder has a top end and a bottom end, and wherein the bottom end is configured with a first plurality of gear teeth extending circumferentially about said cylinder.

3. An ice dispensing assembly as in claim 2, further comprising a motor having a second plurality of gear teeth in mechanical communication with said first plurality of gear teeth of said cylinder;

wherein said first and second plurality of gear teeth are each beveled so as to facilitate their proper alignment with each other.

4. An ice dispensing assembly as in claim 1, further comprising a motor in mechanical communication with said cylinder and configured to selectively cause said cylinder to rotate about said shaft.

5. An ice dispensing assembly as in claim 4, wherein said motor causes said cylinder to rotate in one direction for crushed ice and to rotate in an opposite direction for non-crushed ice.

6. An ice dispensing assembly as in claim 1, further comprising a metering plate attached to said shaft, said metering plate defining an aperture with teeth along at least one edge of the aperture that are configured for breaking ice.

7. An ice dispensing assembly as in claim 1, wherein said base further comprises a circumferentially-extending groove into which a bottom end of said cylinder is received.

8. An ice dispensing assembly as in claim 1, wherein said bridge and said at least one rotatable blade are constructed as an integral piece.

9. An ice dispensing assembly as in claim 1, wherein the bottom of said container is sloped towards the first opening defined by the bottom.

10. An ice dispensing assembly as in claim 1, wherein said container defines a skirt positioned along the bottom of said container, said skirt including a taper for positioning of the ice dispensing assembly onto a platform in an appliance.

11. An ice dispensing assembly as in claim 1, wherein said at least one rotatable blade defines a plurality of teeth along and said non-rotatable blade defines a plurality of teeth oriented such that ice is crushed between teeth of the rotatable blade and the non-rotatable blade when the cylinder is rotating in a crushing direction.

12. A refrigerator, comprising:

a cabinet;

a flesh food compartment, a freezer compartment, or both;

an ice maker;

an ice dispensing assembly, comprising:

a container for the receipt of ice from said ice maker, said container having a bottom defining a first opening for the passage of ice from said container;

a cylindrically-shaped sleeve connected with the opening at the bottom of said container and extending from the bottom of said container;

a base connected with said sleeve, said base defining a second opening for the passage of ice from said container;

a cylinder positioned at least partially within said sleeve and rotatable with respect to said sleeve, said cylinder having a wall and defining an inner diameter;

at least one rotatable blade extending along the inner diameter between opposing ends positioned at the wall of said cylinder, said at least one rotatable blade defining a guide hole that is centrally positioned along said at least one rotatable blade;

a shaft extending along a vertical direction perpendicular to said base into said cylinder and through the guide hole of said at least one rotatable blade, said shaft having a bottom end connected to said base;

at least one non-rotating blade attached to said shaft; and a bridge connected along opposing ends to the wall of said cylinder and projecting away from said cylinder along the vertical direction to a central portion that defines an opening for receipt of a top end of said shaft.

13. A refrigerator as in claim 12, further comprising a metering plate attached to said shaft, said metering plate defining an aperture with teeth along at least one edge of the aperture that are configured for breaking ice.

14. A refrigerator as in claim 12, wherein said base further comprises a circumferentially-extending groove into which a bottom end of said cylinder is received.

15. A refrigerator as in claim 12, further comprising a motor in mechanical communication with said cylinder and configured to selectively cause said cylinder to rotate about said shaft, and;

at least one processing device in communication with said motor and configured for controlling said motor so as to determine the direction of rotation of said cylinder depending upon whether the dispensing of ice or crushed ice has been selected by a user.

16. A refrigerator as in claim 12, wherein said at least one rotatable blade comprises a plurality of rotating blades.

17. A refrigerator as in claim 12, wherein said at least one non-rotating blade comprises a plurality of non-rotating blades.

18. An ice dispensing assembly for an appliance, comprising:

a container for the receipt of ice, said container having a bottom defining a first opening for the passage of ice from said container;

a cylindrically-shaped sleeve connected with tile first opening at the bottom of said container and extending from the bottom of said container;

a base connected with said sleeve, said base defining a second opening for the passage of ice from said container;

a cylinder positioned at least partially within said sleeve and rotatable with respect to said sleeve, said cylinder having a wail and defining an inner diameter;

at least one rotatable blade carried by said cylinder and extending along tile inner diameter between opposing ends positioned at the wall of said cylinder, said at least one rotatable blade defining a guide hole that is centrally positioned along said at least one rotatable blade;

a shaft extending along a vertical direction perpendicular to said base into said cylinder and through the guide hole of said at least one rotatable blade, said shaft having a bottom end connected to said base; and at least one non-rotating blade attached to said shaft;

a bridge connected along opposing ends to the wall of said cylinder and projecting away from said cylinder along the vertical direction to a central portion that defines an opening for receipt of a top end of said shaft; and a metering plate attached to said shaft, said metering plate defining an aperture having a plurality of teeth along at least one edge of the aperture that are configured for breaking ice.

19. An ice dispensing assembly as in claim 18, wherein said bottom end of the shaft is hexagonally-shaped.

20. An ice dispensing assembly as in claim 19, wherein said base defines a hexagonally-shaped hole for receiving the hexagonally-shaped bottom end of the shaft to connect said bottom end of the shaft to said base.

* * * * *